US008182036B2

(12) United States Patent
Nishino

(10) Patent No.: US 8,182,036 B2
(45) Date of Patent: May 22, 2012

(54) ROCKING CHAIR

(75) Inventor: Itaru Nishino, Yokohama (JP)

(73) Assignee: Science Road International Inc., Yokohama-Shi (JP)

( * ) Notice: Subject to any disclaimer, the term of this patent is extended or adjusted under 35 U.S.C. 154(b) by 23 days.

(21) Appl. No.: 12/995,372

(22) PCT Filed: Jun. 14, 2009

(86) PCT No.: PCT/JP2009/002691

§ 371 (c)(1),
(2), (4) Date: Nov. 30, 2010

(87) PCT Pub. No.: WO2009/157148

PCT Pub. Date: Dec. 30, 2009

(65) Prior Publication Data

US 2011/0089733 A1 Apr. 21, 2011

(30) Foreign Application Priority Data

Jun. 24, 2008 (JP) ..... 2008-004262-U

(51) Int. Cl.
*A47C 3/02* (2006.01)

(52) U.S. Cl. ..... 297/259.1; 297/258.1

(58) Field of Classification Search ..... 16/20; 248/430, 248/416; 297/318, 344.26, 263.2, 258.1, 297/259.1, 259.2, 259.3, 261.1
See application file for complete search history.

(56) References Cited

U.S. PATENT DOCUMENTS 229,733 A * 7/1880 Michaels ..... 297/263.2
2,364,516 A * 12/1944 Buckstaff ..... 248/425
2,553,652 A * 5/1951 Gradle et al. ..... 248/430
2,587,679 A * 3/1952 Atkinson ..... 296/68
4,709,649 A * 12/1987 Wann ..... 114/363
4,815,785 A * 3/1989 Goodall et al. ..... 296/65.13
(Continued)

FOREIGN PATENT DOCUMENTS

JP 49-28468 A 3/1974
(Continued)

OTHER PUBLICATIONS

International Search Report, dated Aug. 25, 2009, issued in PCT/JP2009/002691.

*Primary Examiner* — Milton Nelson, Jr.
(74) *Attorney, Agent, or Firm* — Birch, Stewart, Kolasch & Birch, LLP

(57) ABSTRACT

A rocking chair (1) is provided with a seat (30), a projecting member (40) provided on the lower side of the seat (30) and having a convex surface (41*a*) forming a part of a spherical surface (b) centered on a point (A) located above the seat (30), swivel casters (20) in contact with the convex surface (41*a*) of the projecting member (40) and guiding the projecting member (40) such that the projecting member (40) can rock along the spherical surface (b), and a support member (10) for the chair. The swivel casters (20) are mounted such that the axes (a) of swivel shafts (22) of the swivel casters (20) pass through the center point (A) of the spherical surface (b), and the seat (30) is guided in the direction of a force applied by rollers (25) of the swivel casters (20). Rocking of the projecting member (40) is smoother than that in rocking chairs using ball casters instead of the swivel casters (20), and noise caused by rocking is drastically reduced. The chair can be produced inexpensively because the swivel casters are inexpensive.

2 Claims, 2 Drawing Sheets

U.S. PATENT DOCUMENTS

| | | | | |
|---|---|---|---|---|
| 4,974,904 | A | 12/1990 | Phillips et al. | |
| 5,518,475 | A * | 5/1996 | Garland | 482/68 |
| 5,590,930 | A | 1/1997 | Glockl | |
| 6,988,719 | B2 * | 1/2006 | Ursell et al. | 269/289 MR |

FOREIGN PATENT DOCUMENTS

| | | | |
|---|---|---|---|
| JP | 2-51540 | U | 4/1990 |
| JP | 7-503392 | A | 4/1995 |
| JP | 7-275073 | A | 10/1995 |

* cited by examiner

ROCKING CHAIR

BACKGROUND OF THE INVENTION

1. Field of the Invention

The present invention relates to a rocking chair whose seat taken by a chair occupant can rock on a point above the seat.

2. Description of the Related Art

A rocking chair having a seat taken by a chair occupant performing arc motion around a point above the seat, preferably the point located near a gravity point of the occupant's body, has been developed for the purpose of, for example, recovery of tired lumbar muscle after long-term seating, prevention or treatment of lumbago, and lumbar muscle training in rehabilitation.

Such rocking chair is disclosed in JP 2-51540 U. The chair in this reference literature has a seat, a curved upper plate for supporting the seat which is provided on the lower side of the seat and has a convex surface facing downwardly, and a curved base plate for guiding the upper plate which is located below the upper plate and has a concave surface corresponding to the convex surface of the upper plate. The upper plate can slide on the base plate to rock on a point above the seat. A preferred embodiment described in the reference literature has ball casters provided on the concave surface of the base plate in order to smooth the rocking motion of the upper plate. The upper plate in the embodiment rocks on the ball casters.

In JP 7-503392 A, there is disclosed another active dynamic seat (rocking chair) having a seat, a dish-shaped seat shell which is provided on the lower side of the seat and designed to be convex in the downward direction, an intermediate member having a head part with a bearing engaging the seat shell so as to enable the seat shell to rock, and a support member connected to the intermediate member. The bearing has a plurality of balls rotatably supported in one cage or plural cages. That is, the bearing has a plurality of ball casters. The seat shell can move on the ball casters to rock on a point above the seat.

According to the rocking chair, as disclosed in the above reference literatures, comprising a projecting member provided on the lower side of the seat and having a convex surface forming a part of a spherical surface centered on a point located above the seat (the upper plate in the chair of JP 2-51540 U, the seat shell in the chair of JP 7-503392 A), and a guide member in contact with the convex surface of the projecting member and guiding the projecting member such that the projecting member can rock along the spherical surface (the base plate or the ball casters in the chair of JP 2-51540 U, the ball casters in the chair of JP 7-503392 A), the seat can freely rotate and can tilt in the direction of a force applied by a chair occupant.

Thus, the occupant of such chair can sway or twist his or her lumbar part on the seat. Further, efficient recovery of tired lumbar muscle, prevention or relaxation of lumbago, or lumbar muscle training in rehabilitation is achieved by using such chair, because the occupant's lumbar muscle is always exercised when he or she returns the seat in neutral position in order to maintain balance. Additionally, safe and trouble-free use is ensured even for a first-time user, since rocking of the seat is not accompanied with shift of a gravity point of the user sitting on the chair. As far as the present invention, the word "neutral position" means the position occupied by each component (the seat, for example) of a rocking chair without a circumferential external stress on the seat.

However, the rocking chair as disclosed in JP 2-51540 U having, as the guide member, the base plate with the concave surface corresponding to the convex surface of the projecting member does not have little success in smooth rocking motion of the seat due to friction induced between the concave surface and the convex surface. The use of the ball casters as the guide member also results in insufficient rocking motion smoothness, the reason is that deformation of the projecting member and the ball casters, which is caused by body weight of the occupant sitting on the seat, increases friction resistance in the rotating motion of the balls and the sliding motion of the projecting member on the balls.

Another problem is very big noise caused by the balls-rotation of the ball casters. This over loud noise prevents continuation of works such as deskwork and rehabilitation, when plural persons use the chairs having the ball casters in one room. In order to solve the problem of the big noise, lift of the seat by magnetic or hydraulic equipment might be effective solution. But, only a big and expensive rocking chair is manufactured by this solution. Highly-refined processing for obtaining exact spherical surfaces also makes the chair expensive

BRIEF SUMMARY OF THE INVENTION

1. Problems to be Solved by the Invention

It is therefore an object of this invention to provide a rocking chair having increased smoothness in seat rocking motion, reduced noise, and being able to produce inexpensively.

2. Means for Solving Problems

The above-mentioned object is achieved by a rocking chair of the present invention comprising a seat; a projecting member provided on the lower side of the seat and having a convex surface forming a part of a spherical surface centered on a point located above the seat; a guide member in contact with the convex surface of the projecting member for guiding the projecting member so as to enable the projecting member to rock along the spherical surface, and a support member installed with the guide member for supporting the seat through the guide member and the projecting member, wherein the guide member comprises swivel casters, each of the swivel casters having a roller in contact with the convex surface of the projecting member, a yoke rotatably connecting the roller, and a swivel shaft fixed to the support member and rotatably connecting the yoke, each of the swivel shafts having a central axis passing through the center of the spherical surface.

In the rocking chair of the present invention, the convex surface of the projecting member is produced such that it forms a part of the spherical surface centered on the point located above the seat, and each of the swivel casters is aligned such that the central axis of its swivel shaft passes through the point, that is, the center of the spherical surface. The following is achieved by this configuration. When the seat is subjected to a force applied by a chair occupant, the projecting member supported on the rollers of the swivel casters and thus the seat connected to the projecting member tilt in the direction of the force applied. At the same time, the yoke of each swivel caster swivels on the swivel shaft so that the roller connected thereto turns in the same direction as the moving direction of the projecting member and the seat. The rollers of the swivel casters continue to rotate with contact to the convex surface of the projecting member, during the swiveling of the yokes, and also after the yokes stop swiveling till the seat stops moving. As a result, the projecting member is assuredly guided by means of the rollers in the direction of the force applied. Repeat of the process leads to rocking of the projecting member on the rollers along the spherical surface.

Swivel casters are, in normal use, fixed with legs of wagons or chairs as means of transportation. In the normal use, the swivel casters move two-dimensionally on a flat surface. However, the method of using the swivel casters in the present invention is different from that in the above-mentioned normal use, and they are used for guiding the convex surface (a part of the spherical surface).

Further, it is found that the rocking motion of the projecting member along the spherical surface in the rocking chair of the present invention is smoother than that in rocking chairs using ball casters as the guide members. This arises from the fact that a contact area between the rollers of the swivel casters and the convex surface of the projecting member is larger than that between balls of the ball casters and the convex surface. As mentioned above, body weight of the chair occupant sitting on the seat causes deformation of the projecting member and the swivel casters or ball casters as the guide member. The larger contact area is related to the lower deformation. The lower deformation leads to lower friction resistance and smoother sliding of the projection member on the swivel casters.

In a preferred embodiment of the present invention, the guide member has at least three of the swivel casters. They are installed to the support member along a circular line at substantially equidistant spaces. Each of the at least three swivel caster has the swivel shaft whose central axis passes through the center of the spherical surface. According to the preferred embodiment, the projecting member in the neutral position is stably supported by the at least three swivel casters, and it can assuredly and smoothly move in an arbitrary direction of 360-degree circumference.

3. Advantageous Effect of the Invention

In the rocking chair of the present invention comprising the projecting member provided on the lower side of the seat and having the convex surface forming a part of the spherical surface centered on the point above the seat, and the guide member for ensuring the rocking motion of the projecting member, the guide member comprises the swivel casters which, in normal use, move two-dimensionally on a flat surface, and each of the swivel casters has the swivel shaft with the central axis passing through the center of the spherical surface. By this specific configuration, the projecting member can be guided in the direction of a force applied through the rollers of the swivel casters, and can rock along the spherical surface. Rocking of the projecting member along the spherical surface is smoother than that in the chair with the ball casters as the guide member. Noise accompanied with the rocking motion of the projecting member is drastically reduced compared to that in the chair having the ball casters, because the swivel casters themselves have good quiet and the movement of the projecting member on the swivel casters is more stable and smoother. Additionally, the rocking chair of the present invention can be produced inexpensively due to the inexpensive swivel casters.

DETAILED DESCRIPTION OF THE INVENTION

Figure 1:
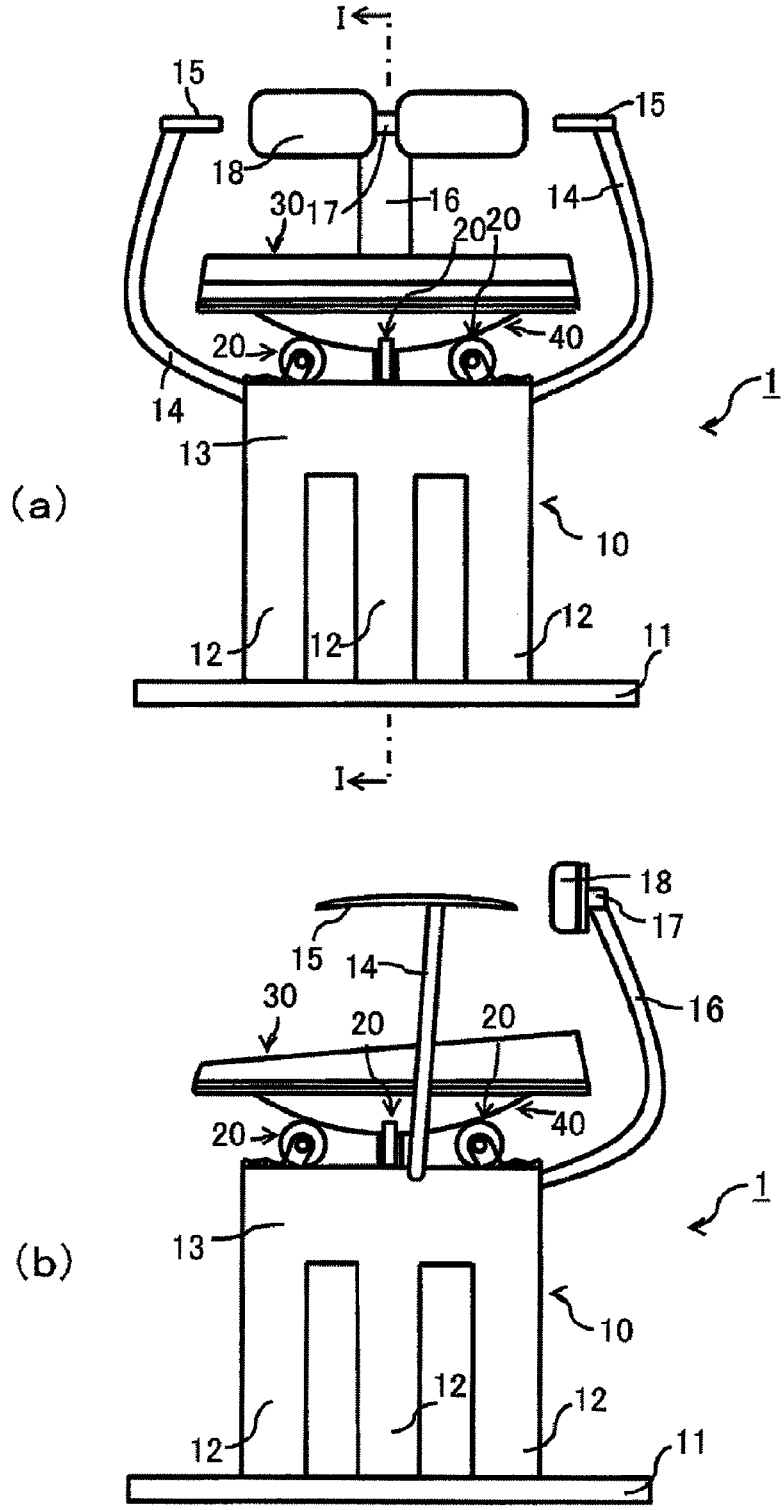
FIG. 1 schematically illustrates an embodiment of a rocking chair of the present invention, in which, (a) is a front view and (b) is a side view.

The present invention will be described in further detail by the following embodiment with reference to the accompanying drawings. FIG. 1(*a*) and FIG. 1(*b*) schematically illustrate a front view and a side view of a rocking chair of this embodiment, respectively.

A rocking chair 1 of this embodiment has, as essential components, a support member 10, swivel casters 20 as a guide member, a seat 30 to be taken by a chair occupant, and a projecting member 40 provided on the lower side of the seat 30.

The support member 10 has a plate-shaped leg part 11 to be placed on a floor, four pole parts 12 vertically-elongated from the upper side of the leg part 11 and located along a circular line at substantially equidistant spaces, and a cylindrically-shaped mounting part 13 on the end of the pole parts 12. The mounting part 13 has at the side edges a pair of arms for armrest 14. Each of the arms for armrest 14 has a laterally-elongated portion followed by an upwardly-elongated portion, and has at the end thereof an armrest 15. The mounting part 13 further has at the back edge an arm for backrest 16, the arm for backrest 16 having a backwardly-elongated portion followed by an upwardly-elongated portion. At the end of the arm for backrest 16, there is provided a backrest supporter 17 extending laterally and having on its surface a back rest 18.

Figure 2:
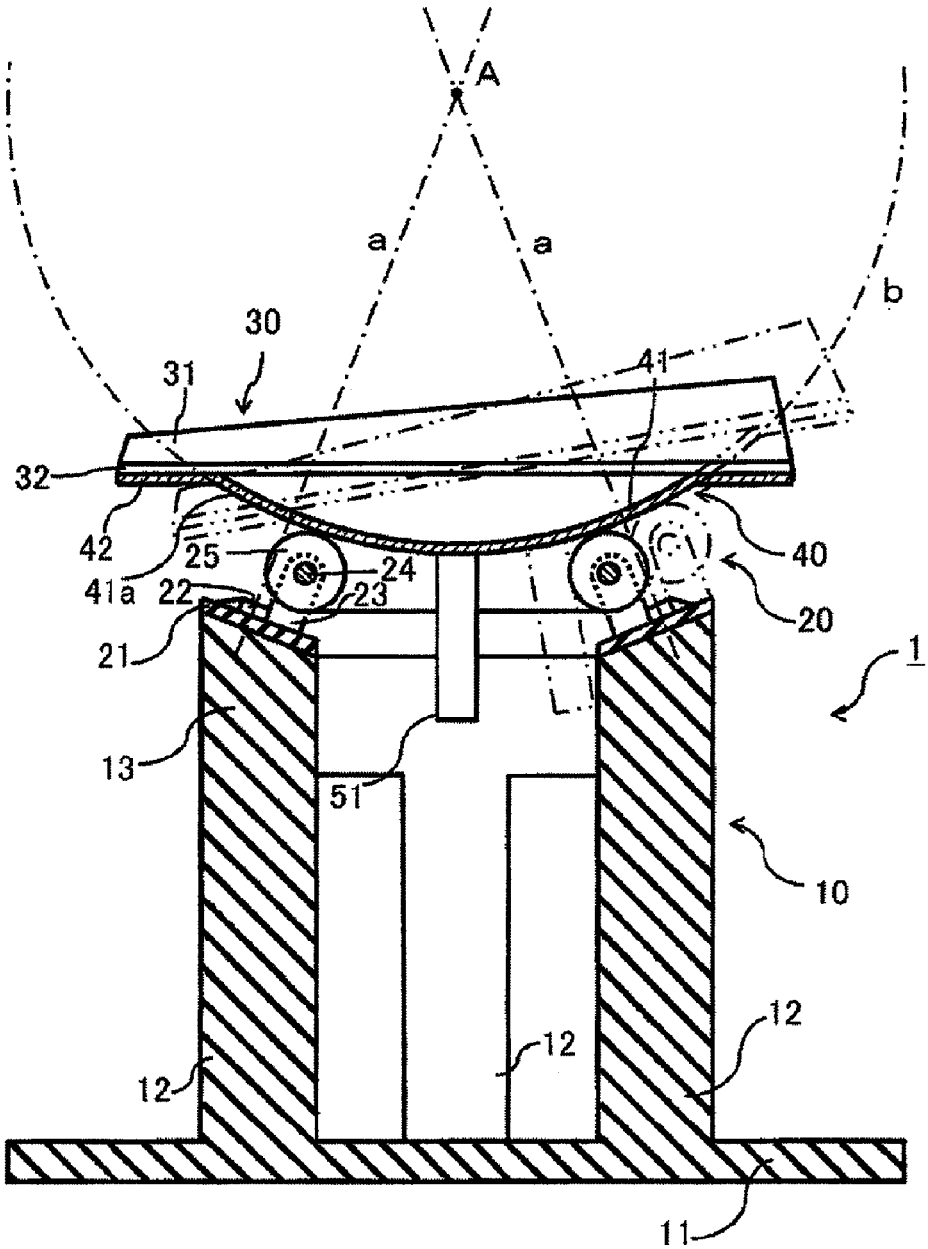
FIG. 2 is a schematic section view taken on line I-I of FIG. 1 (*a*).

FIG. 2 illustrates a schematic section view taken on line I-I of FIG. 1 (*a*). For the sake of understanding, the arms for armrest 14, the armrests 15, the arm for backrest 16, the backrest supporter 17, and the backrest 18 are omitted.

As presented in FIG. 2, the cylindrically-shaped mounting part 13 has a top surface downwardly-inclined toward an inner surface thereof. Four swivel casters 20 are connected on the top surface and placed along a circular line at substantially equidistant spaces. In the rocking chair 1 of the embodiment, one of the swivel casters 20 is located just above one of the pole parts 12.

Each of the swivel casters 20 has a roller 25, a yoke 23 rotatably connecting the roller 25 through a rotating shaft 24, and a swivel shaft 22 rotatably connecting the yoke 23, and an attachment plate 21 on which the swivel shaft 22 is provided. The attachment plates 21 are screwed on the top surface of the mounting part 13 of the support member 10 by bolts (not shown) in order to fix the swivel shafts 22 to the mounting part 13. In each of the swivel casters 20, the rotating shaft 24 for the roller 25 is not located over the central axis a of the swivel shaft 22, and the yoke 23 swivels on the swivel shaft 22. Further, each of swivel casters 20 is aligned such that the central axis a of its swivel shaft 22 passes through a point A above the seat 30.

The projecting member 40 provided on the lower side of the seat 30 is put on the rollers 25 of the swivel casters 20.

The seat 30 has a rectangle-shaped base plate 32 and a seat cushion 31 provided on the upper side of the base plate 32. The seat cushion 31 increases in thickness toward the back edge thereof By this specific shape of the seat cushion 31, an occupant sitting on the seat cushion 31 can maintain good balance and can easily move the seat 30 backward.

The projecting member 40 has a dome part 41 and a flange part 42 integrated to the dome part 41 at its periphery. The projecting member 40 is fixed to the lower side of the seat 30 by screwing the flange part 42 to the lower side of the base plate 32 by bolts (not shown). A convex surface 41*a* facing downwardly of the dome part 41 is produced such that it forms a part of a spherical surface b centered on the point A through which the central axes a of the swivel shafts 22 in all of the swivel casters 20 pass.

At the lower end of the dome part 41, there is provided a protruding part 51 extending downward. The protruding part 51 has a length sufficient to encounter the inner surface of the mounting part 13 in the support member 10 when the projecting member 40 and the seat 30 are tilted. Departure of the seat 30 from the support member 10, or fall of the chair occupant from the too-tilted seat 30 is prevented by the encounter between the protruding part 51 and the inner surface of the mounting part 13.

Movement of the rocking chair 1 of the embodiment is explained next. When the seat 30 in neutral position is subjected to a circumferential force applied by the chair occupant sitting on the seat 30 (a backward force in FIG. 2), the projecting member 40 supported by the rollers 25 of the swivel casters 20 tilts, along the spherical surface b centered on the point A, from the neutral position in the direction of the force applied Simultaneously, the yokes 23 of the swivel casters 20 swivel on the swivel shafts 22 such that the rollers 25 connected thereto turn in the moving direction of the projecting member 40. During the swiveling motion of the yoke 23, the rollers 25 continue to rotate with contact to the convex surface 41*a* of the dome part 41 in the projecting member 40. Accordingly, the projecting member 40 and thus the seat 30 connected with the projecting member 40 are securely and smoothly guided in the direction of the force applied. When the occupant stops to apply the force to the seat or when the protruding part 51 encounters the inner surface of the mounting part 13 in the support member 10, the tilting motion of the seat 30 stops. The virtual lines in FIG. 2 present the swivel casters 20, the seat 30, the projecting member 40, and the protruding part 51 at the moment that the protruding part 51 encounters the inner surface of the mounting part 13 in the support member 10.

When the chair occupant works his or her lumbar muscle to exert an opposite force to the seat 30 with the purpose of restoring the seat 30 into the neutral position, the projecting member 40 supported by the rollers 25 of the swivel casters 20 tilts, along the spherical surface b centered on the point A, in the direction of the neutral position Simultaneously, the yokes 23 of the swivel casters 20 swivel on the swivel shafts 22 so that the rollers 25 connected thereto turn in the moving direction of the projecting member 40. During the swiveling motion of the yoke 23, the rollers 25 continue to rotate with contact to the convex surface 41*a* of the dome part 41 in the projecting member 40. Accordingly, the projecting member 40 and thus the seat 30 connected with the projecting member 40 are securely and smoothly guided to return to the neutral position.

According to the rocking chair 1 of the embodiment, the projecting member 40 and thus the seat 30 connected with the projecting member 40 can rocks in an arbitrary direction of 360-degree circumference, in addition to free seat-rotation.

Having described a specific embodiment of the present invention, it is to be understood that various changes and modifications may be made in the invention without departing from the spirit and scope thereof.

For example, the swivel casters need not to be aligned along a horizontal circular line. The swivel caster 20 near the front edge of the seat 30 can be located lower than the other swivel casters 20, in order that the backward movement distance is longer than the forward movement distance. Further, an extensible connecting element can be applied for connecting the projecting member 40 with the seat 30, in order to adjust a distance between the center A of the spherical surface b and the seat 30. The lumbar muscle training tailored to the occupant's body size can be done by this variant, because the center A of the spherical surface b can be laid near a gravity point of the occupant's body by adjusting the length of the connecting element.

The rocking chair of the invention can be suitably applied to obtain, for example, office chairs for computer users or the like, chairs for rehabilitation, and healthcare equipments for muscle training in the lumbar region, as well as cradles.

What is claimed is:

1. A rocking chair comprising:

a seat;

a projecting member provided on the lower side of the seat and having a convex surface forming a part of a spherical surface centered on a point located above the seat;

a guide member in contact with the convex surface of the projecting member for guiding the projecting member so as to enable the projecting member to rock along the spherical surface, and a support member installed with the guide member for supporting the seat through the guide member and the projecting member, the guide member comprising swivel casters, each of the swivel casters having a roller in contact with the convex surface of the projecting member, a yoke rotatably connecting the roller, and a swivel shaft fixed to the support member and rotatably connecting the yoke, each of the swivel shafts having a central axis passing through the center of the spherical surface.

2. The rocking chair according to claim 1, wherein at least three of the swivel casters are comprised in the guide member and the at least three swivel casters are aligned along a circular line at substantially equidistant spaces.

* * * * *